US007014070B1

(12) United States Patent
Stefely et al.

(10) Patent No.: US 7,014,070 B1
(45) Date of Patent: Mar. 21, 2006

(54) MULTI-PURPOSE CAULKING GUN

(76) Inventors: Stephen F. Stefely, 941 Euclid Ave., Elmhurst, IL (US) 60126; Thomas J. Stefely, 6835 Hampshire, Lisle, IL (US) 60532

( * ) Notice: Subject to any disclaimer, the term of this patent is extended or adjusted under 35 U.S.C. 154(b) by 0 days.

(21) Appl. No.: 10/930,241

(22) Filed: Aug. 31, 2004

(51) Int. Cl.
*B65D 88/54* (2006.01)

(52) U.S. Cl. ..... 222/327; 222/391

(58) Field of Classification Search ..... 222/327, 222/391
See application file for complete search history.

(56) References Cited

U.S. PATENT DOCUMENTS

| | | | | |
|---|---|---|---|---|
| 3,369,714 | A * | 2/1968 | Dewees et al. | 222/327 |
| 4,509,662 | A | 4/1985 | Weiss | |
| 5,104,005 | A | 4/1992 | Schneider, Jr. et al. | |
| 5,224,628 | A * | 7/1993 | Keller | 222/327 |
| 5,875,920 | A | 3/1999 | Parent | |
| 6,401,988 | B1 * | 6/2002 | Parent et al. | 222/391 |
| 6,488,180 | B1 | 12/2002 | Bayat | |

* cited by examiner

*Primary Examiner*—Philippe Derakshani
(74) *Attorney, Agent, or Firm*—Philip H. Kier

(57) ABSTRACT

A C-gun type caulk gun capable of accepting disposable caulk tubes having different outside diameters within a similar caulk tube body length.

8 Claims, 2 Drawing Sheets

MULTI-PURPOSE CAULKING GUN

BACKGROUND OF THE INVENTION

This invention pertains to caulking guns for dispensing mastic compounds. More particularly, it pertains to a caulking gun capable of using disposable caulk tubes of different diameters, in the same caulking gun.

Caulking guns are used to apply sealants and adhesives, hereafter referred to as mastic compounds, when installing windows and doing general caulking and bonding on buildings. Caulking guns used by tradesmen to apply mastic compound fall into one of two general types. The first type is a bulk dispensing gun which is a complete unit unto itself, comprising a closed refillable cylindrical chamber containing a spout, a plunger within the cylinder and an actuating means to move the plunger forward to dispense the mastic compound from the cylinder.

The second type of caulking gun found in today's market place, is one that has an open frame structure to support a single disposable caulking tube and an actuating mechanism designed to move a push rod assembly for dispensing the mastic compound contained in the disposable caulking tube. The push rod assembly consists of a single push rod with a single thrust disk attached to one end of the push rod. The current common open frame caulk tube gun, hereafter referred to as the "C-gun". Each C-gun is currently designed hold one specific size disposable caulk tube having a plastic spout on one end and a movable plunger on the opposite end. The present invention is concerned with the C-gun, and in the following discussion the term "caulking gun" should be understood as referring to a C-gun type caulking gun.

Currently only two C-gun type sizes are commercially available. One C-gun has a nominal cradle length of 23 cm (9 inches) and is sized to receive a 0.35 liter (12.8 fluid ounce) caulk tube with an inside diameter of approximately 4.6 cm. (1 13/16 inches). This tube size is referred to hereafter as "size A" tube. The second C-gun with a nominal cradle length of 13 inches is sized to receive a 0.95 liter (32 fluid ounce) disposable caulk tube which has an inside diameter of approximately 6.2 cm (2 7/16 inches). This tube size is referred to hereafter as "size B" tube. The length of each conventional C-gun is designed to receive only one specific size disposable caulk tube; either a "size A" caulk tube or a "size B" caulk tube. Also, the diameter of the thrust disk on each conventional C-gun is intentionally designed to be used exclusively with the plunger in either a "size A" caulk tube or "size B" caulk tube. To the inventors' knowledge no one offers a C-gun having a single thrust disk capable of fitting into the inside diameter of plungers for a "size A" and a "size B" disposable caulk tube. Also no one offers a C-gun capable of using disposable caulk tubes with different outside diameters within the same C-gun cradle.

Since the introduction of disposable caulking tubes (1920's), there have been only two standard size disposable caulk tubes available in general commerce, a small size (size A) and a large size (size B). The small size has a body length of 20.3 to 21.6 cm. (8.0 to 8.5 inches), and has an outer diameter of 4.4 to 5.1 cm (0.1.75 to 2.0 inches), and has a net content of approximately 0.31 liters (10.5 fluid ounces) of mastic compound (the 0.38 liter (12.8 fluid ounce gross capacity of the caulk tube is not completely filled with mastic). The large size has a body length of 31 to 31.8 cm (12.25 to 12.50 inches), and has an outer diameter of 6 to 6.7 cm (2.38 to 2.63 inches), and has a net content of approximately 0.9 liter (30 fluid ounces) of mastic compound. These two disposable caulk tubes are currently the only disposable caulk tube sizes produced for use in C-guns sold to the general public and tradesmen using mastic compounds. However, the inventors have developed a new novel size disposable caulk tube that has the diameter of the "size B" disposable caulk tube and the body length of the "size A" disposable caulk tube. This novel sized caulking tube, which is the subject of pending application Ser. No. 10/886,178, is referred to hereafter as a "size C" caulk tube.

Because size A disposable caulk tubes are being sold and size C disposable caulk tubes will soon be on the market, there is a need for having single C-gun capable of receiving either a size A and a size C caulk tube. The C-gun of this invention is designed to receive only one tube at a time, and is easily adept at receiving either a size A or a size C disposable caulk tube (as selected by the user). In its simplest embodiment, this novel C-gun accepts either a size A or C caulk tube with no adjustments being required. The benefits of having a multi-purpose C-gun capable of holding a single tube of either "size A" or "size C" caulk tubes is realized in the economics of manufacturing (one gun serving two purposes) and in the broader utility embodied in a single multi-purpose C-gun that is compatible with multiple sizes of disposable caulk tubes, which will benefit workmen applying mastic compound.

It is an object of the present invention to embody within one multi-purpose C-gun the capability of dispensing mastic compounds from either a standard "size A" disposable caulk tube or the novel "size C" disposable caulk tube.

SUMMARY OF THE INVENTION

The multi-purpose C-gun of the present invention is designed to dispense mastic compounds from disposable caulk tubes with body lengths of 20.3 to 21.6 cm, (8.0 to 8.5 inches) and caulk tubes which have variable outer diameters, ranging from 4.4 to 6.7 cm (1.75 to 2.63 inches). This multi-purpose C-gun has a conventional structure including a cradle for receiving disposable caulk tubes, a forward end plate with a slot for retaining and centering the spout of the caulk tube, a push rod assembly with an attached thrust disk means on one end, and an activating mechanism to move the push rod forward, causing the thrust disk means to contact and move the tube plunger to dispense mastic compound from the caulk tube. The dual-purpose C-gun differs from conventional designs in that the forward end plate can be modified to hold either size A or size C caulk tubes, and that there may be multiple thrust disks.

BRIEF DESCRIPTION OF THE SEVERAL VIEWS

FIG. 1*a* is a perspective view of a size A disposable caulk tube.

FIG. 1*b* is a perspective view of a size B disposable caulk tube.

FIG. 1*c* is a perspective view of a size C disposable caulk tube.

DETAILED DESCRIPTION OF THE INVENTION

Figure 1A:
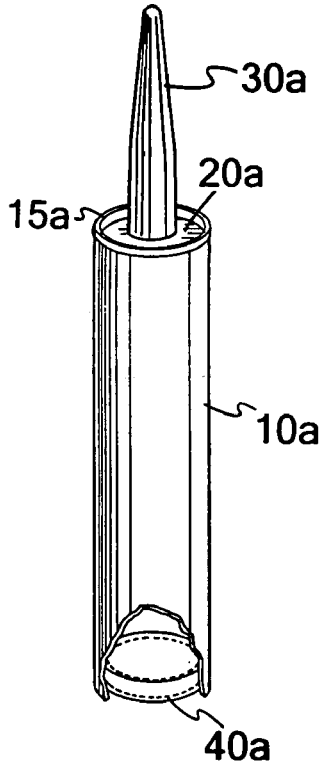
Figure 1B:
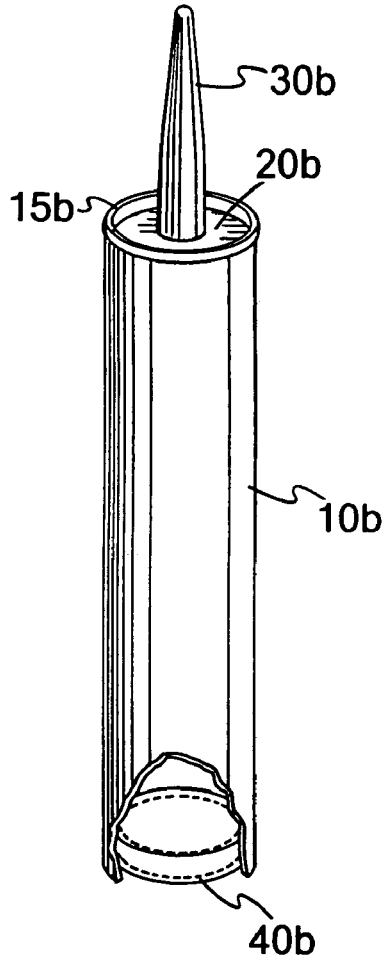
Figure 1C:
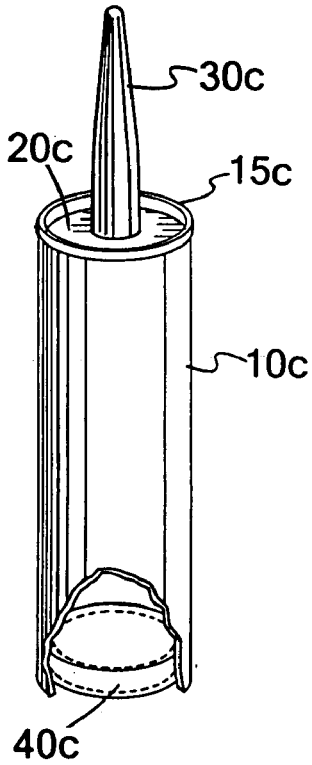

The present invention is directed to a multi-purpose C-gun that may modify and share features with a number of conventional C-guns. To provide a basis for the design of the multi-purpose C-gun, the caulk tubes with which it is used will be described. FIG. 1*a* shows the conventional size A disposable caulk tube. It has a cylindrical body 10*a* a stationary front end 20*a* from which a spout 30*a* protrudes, a plunger 40*a* that is movable within the cylindrical body when subject to external force. The cylindrical body has a front rim 15*a* that extends slightly beyond the front end 20*a* so that the front disk is slightly recessed. FIGS. 1*b* and 1*c* show conventional size B and novel size C caulk tubes. The size B caulk tube has a larger diameter and is longer that the size A caulk tube. The novel size C caulk tube has the same diameter as size B and the same length as size A.

Figure 2:
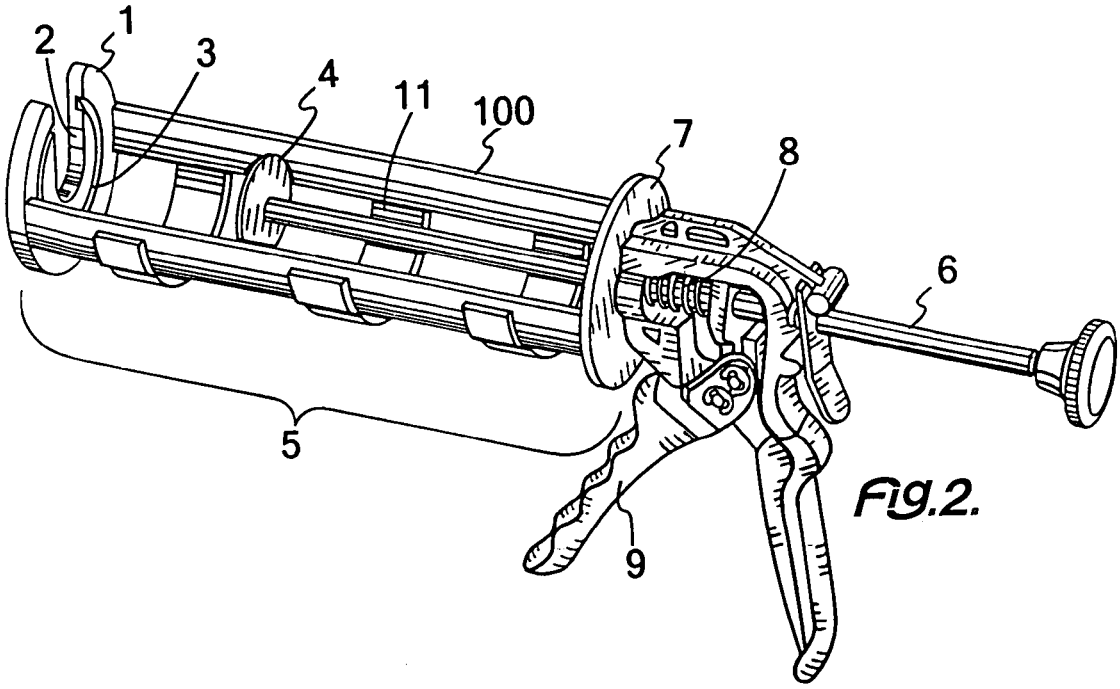
FIG. 2 is a perspective view of the multi-purpose C-gun in its simplest embodiment according to this invention.
Figure 3:
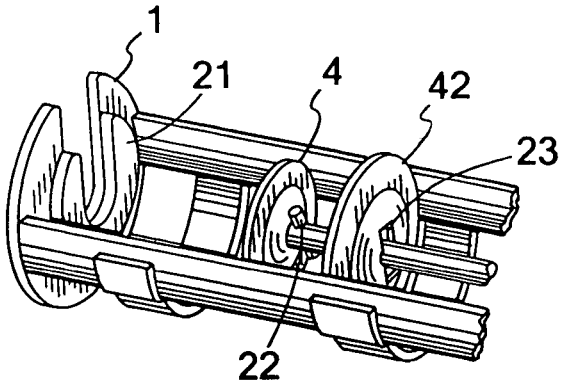
FIG. 3 is a perspective view of the push rod with a fixed thrust disk and a floating thrust disk on the same push rod and raised retainer on front plate.

FIG. 2, shows a representative C-gun that is suitable for the present invention. There is an open framework cradle too for receiving a disposable caulk cartridge. At the front of the cradle, there a front end plate 1 that acts as a stop and that has a receiving slot 2 for receiving the spout 30*a* or 30*c* of a disposable caulk tube. As shown in FIG. 2 and FIG. 3, the front end plate is circular with an outer diameter sized to be capable of receiving a caulk tube with a diameter in the range of 4.4 to 6.7 cm (1.75 to 2.63 inches). At the rear of the cradle there is a rear end plate 7 that is attached to a stock that holds push rod 6, and actuating mechanism 9, which is frequently a trigger. Receiving slot 2 keeps the caulk tube in approximately the same line as the push rod and serves to hold the caulk tube in a manner to reduce its lateral motion within the cradle during use. The rear end plate contains a central hole 8 through which the push rod moves longitudinally. When activated the push rod moves forward so that thrust disk 4 attached to an end of the push rod applies pressure to the plunger(40*a* or 40*c*) of the cartridge, and moves the plunger forward causing mastic compound to be expelled from the spout. The open structure half cylinder cradle 100 of the representative embodiment may be formed by welding longitudinal metal strips 5 to end plates 1 and 7 and welding semi-circular metal straps 11, laterally between longitudinal metal strips 5 to form cradle 100 in which the disposable caulk tube is placed. The cradle of the caulking gun of the present invention is designed to receive a variety of disposable caulk tubes with a body length between 20.3 to 21.6 (8.0 and 8.5 inches) and with an outer diameter between 4.4 to 6.7 cm (1.75 to 2.63 inches). Other cradle designs are also envisioned such as half cylinders, optionally with perforations or slots of various sizes to reduce the weight of the gun.

In the embodiment shown in FIG. 2, there maybe a circular retainer groove 3 in the inner surface of the front end plate. This retainer groove can be sized to hold the rim 15*a* or 15*c* in place and may be stamped or recessed into the front end plate. An alternate embodiment is shown in FIG. 3. That embodiment has two changes from the embodiment shown in FIG. 2. First there is a circular raised retainer disk 21 integral to the inner surface of front end plate 1. The diameter of the circular raised retainer disk is small enough that it can fit within the front rim 15*a* of a size A caulk tube or within the front rim 15*c* of a size C caulk tube. The raised retainer surface would contact the front end of the caulk tube to help center and hold the caulk tube in position. The raised retainer can be can be molded, welded, or stamped in place. It can be stepped so the step with a smaller diameter would retain a size A caulk tube while the step with the larger diameter would retain a size C caulk tube.

The second change is the addition of a second thrust disk 42. Thrust disk 4, which is attached securely to an end of push rod 6 is designed to fit into plunger 40*a* of a size A caulk tube. Thrust disk 42 is designed to fit exclusively into plunger 40*c* of a size C caulk tube. It is situated directly behind thrust disk 4 and is designed to slide along the length of the push rod unless locked in place by a mechanical means, such as a dowel pin, a pressure place that bites into the push rod, a notch, a screw, or a locking collar. The locking means shown in FIG. 3 is a dowel pin 22 penetrating push rod 6 and a corresponding mating slot 23 cut into sliding thrust disk 42. The size of the slot is slightly larger than the size of the dowel pin so that the sliding thrust disk can be moved from one side to the other side of the dowel pin when the slot is aligned with the dowel pin. To lock the sliding disk in place next to fixed thrust disk 4, sliding thrust disk 42 is rotated so that slot 23 is not aligned with dowel pin 22. When locked in place through rotation, the sliding thrust disk is in position to engage the plunger of a size C caulk tube. When the multi-purpose C-gun is used with a size A caulk tube, sliding thrust disk 42 is not locked in place, fixed thrust disk 4 becomes the working disk and thrust disk 42 slides along the push rod as the push rod penetrates deeper in the caulk disk.

The exemplified features are not meant to be limiting. For instance, the cradle can be made of solid sheets, strips of metal, perforated sheets to reduce bulk. The C-gun need not even be made of metal as described. Plastics and composite components are all within the scope and the advantages and disadvantages of each material will be obvious to one skilled in the art. It is within the scope of this invention to incorporate ergonomic handles, drip-less or quick pressure release features, and retaining edges on the front plate, all which have been previously disclosed as improvements over the traditional caulk gun

We claim:

1. A C-gun type caulk gun to be used with multiple diameter disposable caulk tubes having a cylindrical body, a recessed front end from which a spout protrudes, and a movable plunger, the caulk gun comprising:

a cradle having semi-circular cylindrical shape sized to receive any single disposable caulk tubes with a body length of 20.3 to 21.6 cm (8.0 to 8.5) inches and a range of outside diameters between 4.4 and 6.7 cm (1.75 and 2.63 inches);

a rear end plate attached to the cradle and to a stock, the stock holding a push rod with a thrust disk attached to an end, the attached thrust disk sized to fit within a plunger of a caulk tube with an outer diameter in the range of 4.4 to less than 6.7 cm (1.75 to less than 2.63 inches);

an actuating mechanism for the push rod; a circular front end plate having a diameter capable for receiving a caulk tube with a diameter in the range of 4.4 to 6.7 cm. (1.75 to 2.63 inches), having a slot for receiving the spout of the disposable caulk tube the front end plate attached to the cradle and the slot sized so that the spout is nominally aligned with the push rod; and a second thrust disk capable of sliding along the length of the push rod and a mechanical means for the locking the sliding thrust disk in place next to the attached thrust disk, the sliding thrust disk having a larger diameter than the attached thrust disk and the sliding thrust disk fitting within the plunger of a caulk tube with a diameter of 6.0 to 6.7 cm (2.38 to 2.63 inches).

2. A C-gun type caulk gun as set forth in claim 1 wherein the mechanical locking mean is a dowel pin penetrating the push rod and a slot in the sliding thrust disk mated with the dowel pin.

3. A C-gun type caulk gun to be used with multiple diameter disposable caulk tubes having a cylindrical body, a recessed front end from which a spout protrudes, and a movable plunger, the caulk gun comprising:

a cradle having semi-circular cylindrical shape sized to receive any single disposable caulk tubes with a body length of 20.3 to 21.6 cm (8.0 to 8.5) inches and a range of outside diameters between 4.4 and 6.7 cm (1.75 and 2.63 inches);

a rear end plate attached to the cradle and to a stock, the stock holding a push rod with a thrust disk attached to an end, the attached thrust disk sized to fit within a plunger of a caulk tube with an outer diameter in the range of 4.4 to 6.7 cm (1.75 to 2.63 inches); and a circular front end plate having a diameter capable for receiving a caulk tube with a diameter in the range of 4.4 to 6.7 cm. (1.75 to 2.63 inches), having a slot for receiving the spout of the disposable caulk tube and having a plurality of circular raised retainers sized to engage the front end of disposable caulk tubes with different diameters.

4. A C-gun type caulk gun as set forth in claim 3 further comprising a second thrust disk capable of sliding along the length of the push rod and a mechanical means for the locking the sliding thrust disk in place next to the attached thrust disk, the sliding thrust disk having a larger diameter than the attached thrust disk and the sliding thrust disk fitting within the plunger of a caulk tube with a diameter of 6.0 to 6.7 cm (2.38 to 2.63 inches).

5. A C-gun type caulk gun to be used with multiple diameter disposable caulk tubes having a cylindrical body, a recessed front end from which a spout protrudes, and a movable plunger, the caulk gun comprising:

a cradle having semi-circular cylindrical shape sized to receive any single disposable caulk tubes with a body length of 20.3 to 21.6 cm (8.0 to 8.5 inches) and a range of outside diameters between 4.4 and 6.7 cm (1.75 and 2.63 inches);

a rear end plate attached to the cradle and to a stock, the stock holding a push rod with a thrust disk attached to an end, the attached thrust disk sized to fit within a plunger of a caulk tube with an outer diameter in the range of 4.4 to 6.7 cm (1.75 to 2.63 inches); and an actuating mechanism for the push rod; and a circular front end plate having a diameter capable for receiving a caulk tube with a diameter in the range of 4.4 to 6.7 cm. (1.75 to 2.63 inches), having a slot for receiving the spout of the disposable caulk tube and having a circular recess for receiving a caulk tube, the front end plate attached to the cradle and the slot sized so that the spout is nominally aligned with the push rod.

6. A C-gun type caulk gun to be used with multiple diameter disposable caulk tubes having a cylindrical body, a recessed front end from which a spout protrudes, and a movable plunger, the caulk gun comprising:

a cradle having semi-circular cylindrical shape sized to receive any single disposable caulk tubes with a body length of 20.3 to 21.6 cm (8.0 to 8.5) inches and a range of outside diameters between 4.4 and 6.7 cm (1.75 and 2.63 inches);

a rear end plate attached to the cradle and to a stock, the stock holding a push rod with a thrust disk attached to an end, the attached thrust disk sized to fit within a plunger of a caulk tube with an outer diameter in the range of 4.4 to 6.7 cm (1.75 to 2.63 inches);

an actuating mechanism for the push rod; and a circular front end plate having a diameter capable for receiving a caulk tube with a diameter in the range of 4.4 to 6.7 cm. (1.75 to 2.63 inches) and having a slot for receiving the spout of the disposable caulk tube, the front end plate attached to the cradle and the slot sized so that the spout is nominally aligned with the push rod; and a circular raised retainer integral to the front end plate sized to engage the front end of a disposable caulk tube.

7. A C-gun type caulk gun to be used with multiple diameter disposable caulk tubes having a cylindrical body, a recessed front end from which a spout protrudes, and a movable plunger, the caulk gun comprising:

a cradle having semi-circular cylindrical shape sized to receive any single disposable caulk tubes with a body length of 20.3 to 21.6 cm (8.0 to 8.5) inches and a range of outside diameters between 4.4 and 6.7 cm (1.75 and 2.63 inches);

a rear end plate attached to the cradle and to a stock, the stock holding a push rod with a thrust disk attached to an end, the attached thrust disk sized to fit within a plunger of a caulk tube with an outer diameter in the range of 4.4 to less than 6.7 cm (1.75 to less than 2.63 inches);

an actuating mechanism for the push rod; and a circular front end plate having a diameter capable for receiving a caulk tube with a diameter in the range of 4.4 to 6.7 cm. (1.75 to 2.63 inches), having a slot for receiving the spout of the disposable caulk tube and having a circular recess for receiving a caulk tube, the front end plate attached to the cradle and the slot sized so that the spout is nominally aligned with the push rod; and a second thrust disk capable of sliding along the length of the push rod and a mechanical means for the locking the sliding thrust disk in place next to the attached thrust disk, the sliding thrust disk having a larger diameter than the attached thrust disk and the sliding thrust disk fitting within the plunger of a caulk tube with a diameter of 6.0 to 6.7 cm (2.38 to 2.63 inches).

8. A C-gun type caulk gun to be used with multiple diameter disposable caulk tubes having a cylindrical body, a recessed front end from which a spout protrudes, and a movable plunger, the caulk gun comprising:

a cradle having semi-circular cylindrical shape sized to receive any single disposable caulk tubes with a body length of 20.3 to 21.6 cm (8.0 to 8.5) inches and a range of outside diameters between 4.4 and 6.7 cm (1.75 and 2.63 inches), a rear end plate attached to the cradle and to a stock, the stock holding a push rod with a thrust disk attached to an end, the attached thrust disk sized to fit within a plunger of a caulk tube with an outer diameter in the range of 4.4 to less than 6.7 cm (1.75 to less than 2.63 inches);

an actuating mechanism for the push rod; and a circular front end plate having a diameter capable for receiving a caulk tube with a diameter in the range of 4.4 to 6.7 cm. (1.75 to 2.63 inches) and having a slot for receiving the spout of the disposable caulk tube the front end plate attached to the cradle and the slot sized so that the spout is nominally aligned with the push rod;

a circular raised retainer integral to the front end plate sized to engage the front end of a disposable caulk tube; and a second thrust disk capable of sliding along the length of the push rod and a mechanical means for the locking the sliding thrust disk in place next to the attached thrust disk, the sliding thrust disk having a larger diameter than the attached thrust disk and the sliding thrust disk fitting within the plunger of a caulk tube with a diameter of 6.0 to 6.7 cm (2.38 to 2.63 inches).

* * * * *